US012313313B2

(12) United States Patent
Brewer, II

(10) Patent No.: US 12,313,313 B2
(45) Date of Patent: May 27, 2025

(54) METHOD FOR RECHARGING A REFRIGERATED APPLIANCE BY WEIGHING AND DISPENSING SMALL AMOUNTS OF HYDROCARBON REFRIGERANT GASES

(71) Applicant: THERMOFLUID TECHNOLOGIES, INC., Louisville, TN (US)

(72) Inventor: Floyd Eugene Brewer, II, Maryville, TN (US)

(73) Assignee: Thermofluid Technologies, Inc., Louisville, TN (US)

( * ) Notice: Subject to any disclaimer, the term of this patent is extended or adjusted under 35 U.S.C. 154(b) by 113 days.

(21) Appl. No.: 18/483,879

(22) Filed: Oct. 10, 2023

(65) Prior Publication Data

US 2024/0035723 A1 Feb. 1, 2024

Related U.S. Application Data

(60) Provisional application No. 63/534,231, filed on Aug. 23, 2023.

(51) Int. Cl.
*F25B 45/00* (2006.01)
*F25B 49/00* (2006.01)

(52) U.S. Cl.
CPC ..... *F25B 45/00* (2013.01); *F25B 49/00* (2013.01); *F25B 2345/001* (2013.01); *F25B 2345/003* (2013.01); *F25B 2345/007* (2013.01)

(58) Field of Classification Search
CPC .... F25B 45/00; F25B 49/00; F25B 2345/001; F25B 2345/003; F25B 2345/007
See application file for complete search history.

(56) References Cited

U.S. PATENT DOCUMENTS 4,624,112 A * 11/1986 Proctor ..... F25B 45/00 62/149
4,982,576 A * 1/1991 Proctor ..... F25B 49/005 62/503
2013/0008192 A1* 1/2013 McMasters ..... F25B 45/00 62/77

FOREIGN PATENT DOCUMENTS

JP 2001324097 A * 11/2001
KR 20230031596 A * 3/2023
WO WO-2013179241 A2 * 12/2013 ..... F25B 43/043
WO WO-2014165248 A1 * 10/2014 ..... F25B 45/00
WO WO-2020158620 A1 * 8/2020 ..... F25B 45/00

* cited by examiner

*Primary Examiner* — Kun Kai Ma
(74) *Attorney, Agent, or Firm* — Stephens IP Law

(57) ABSTRACT

A method for weighing and dispensing small amounts of HC refrigerant gases for appliances such as refrigerators, room air conditioners, small ice makers, wine coolers, etc. More particularly, it relates to method of weighing and dispensing small quantities of HC, or blended HC, gas refrigerants for such refrigerated appliances. Due to the safety hazards associated with large quantities of HC refrigerant gases in an enclosed space, only small containers, holding pre-measured amounts of HC refrigerant gas, are taken into the enclosed space where the refrigerated appliance is located.

20 Claims, 4 Drawing Sheets

METHOD FOR RECHARGING A REFRIGERATED APPLIANCE BY WEIGHING AND DISPENSING SMALL AMOUNTS OF HYDROCARBON REFRIGERANT GASES

CROSS-REFERENCE TO RELATED APPLICATIONS

This Non-Provisional patent application claims the benefit of U.S. Provisional Patent Application No. 63/534,231 filed on Aug. 23, 2023, which is incorporated herein in its entirety by reference.

STATEMENT REGARDING FEDERALLY SPONSORED RESEARCH OR DEVELOPMENT

Not Applicable

BACKGROUND OF THE INVENTION

1. Field of Invention

The invention relates to a method for recharging a refrigerated appliance by weighing and dispensing small amounts of refrigerants for appliances such as refrigerators, room air conditioners, small ice makers, wine coolers, etc. More particularly, it relates to method of weighing and dispensing small quantities of hydrocarbon, ("HC"), or blended HC, gas refrigerants for such refrigerated appliance.

2. Description of the Related Art

In the field of refrigerators, freezers, room air conditioners, small ice makers, wine coolers, and other similar appliances, (hereinafter "refrigerated appliances"), it is known that the refrigeration systems in such refrigerated appliances have, in the past, utilized various refrigerant gases such as R-12, a Chlorofluorocarbon, ("CFC"), hydrofluorocarbons, ("HFC's") such as R134a, or Hydrofluro-Olefins, ("HFO's"), such as R1234yf. As used herein, the term "refrigerated appliance(s)" refers broadly to appliances such as refrigerators, both residential and commercial refrigerators, room air conditioners, small ice makers, wine coolers, and other appliances that require up to approximately five to six hundred grams of refrigerant gas or less. For instance, those skilled in the art will recognize that a commercial refrigerator typically takes about five hundred grams or less of a refrigerant gas while a residential refrigerator typically has a capacity of about ninety (90) grams or less of a refrigerant gas. It is known in this art, that, prior to 1996, R-12, a CFC, was the prominent refrigerant in mobile air conditioning systems and for refrigerated appliances. As is known in the art, in 1996, due to concerns about the impact of CFC's on the environment, CFC's were replaced by HFC's such as R134a. Because HFC's, like CFC's are known to be powerful greenhouse gases, beginning in 2015, the use of HFC's such as R134a was phased out and such HFC's were replaced with HFO's such as R-1234fy.

The transition from HFC's such as R134a to HFO's such as R1234yf has been driven by the need to address environmental concerns and reduce the impact of HFC's on climate change. While R1234yf is generally considered a more environmentally friendly refrigerant with a lower global warming potential, ("GWP"), for instance, R1234yf has a 100-year GWP of less than one compared to R134a's 100-year GWP of 1,430, this switch is not without its challenges. One of the major concerns is the compatibility of R1234yf with existing equipment and infrastructure designed for R134a. The physical properties of R1234yf differ significantly from R134a, which can lead to system performance issues, potential leaks, and the need for modifications in order to ensure safe and efficient operation. As a result, the industry has been grappling with the costs and complexities of retrofitting existing systems or designing new ones to accommodate R1234yf.

Moreover, while HFO's are not considered to be greenhouse gases and have a negligible contribution to global warming, HFO's are now believed to have other deleterious effects on the environment. For instance, the transition to R1234yf has raised concerns about the increase in the atmospheric burden of trifluoroacetic acid, ("TFA"), which is a part of the large group of between 4,000 and 12,000 chemicals that are considered to be "forever chemicals". R1234yf has a unique degradation pathway in the atmosphere, where it can break down into TFA, a long-lived and stable compound. While TFA is not a potent greenhouse gas, its accumulation in the environment can lead to unintended consequences. Studies have shown that TFA can be washed out of the atmosphere and deposited onto land and water bodies, potentially impacting ecosystems and agricultural practices. Indeed, recent studies have suggested that the switch from R134a to R1234yf has resulted in a significant increase, a nearly 35-fold increase, in the global atmospheric burden of TFA. As a result, a growing number of worldwide governments are now moving to significantly restrict the production and use of both HFC's and HFO's.

In view of the known problems with CFC's, HFC's, and HFO's, there is a growing effort to replace such refrigerant gases with blended HC gases. For instance, U.S. Pat. No. 6,336,333, issued to Gary Lindgren on Jan. 8, 2002, discloses an alternate refrigerant as a substitute for R-12. And, in a prior filed application, commonly owned with the current application, a blended HC refrigerant gas to replace an HFC such as R134a, and a blended HC refrigerant gas to replace an HFO such as R1234yf, are disclosed.

However, using HC or blended HC refrigerant gases in confined spaces is known to create safety hazards. For instance, it is known in the art that accumulating a substantial volume of an HC refrigerant gas, such as propane or butane, (as used herein, "butane" refers to either n-butane or iso-butane), or a blended HC refrigerant gas that is a blend of propane and butane within a confined space raises significant safety concerns due to their inherent flammable and explosive properties. As recognized by those skilled in the art, HC refrigerant gases are highly combustible and can ignite with minimal ignition sources, such as sparks, open flames, or even static electricity. In an enclosed environment, the concentration of these gases can rapidly reach levels that exceed their lower explosive limits, leading to the potential for sudden and violent explosions. Additionally, the buildup of such gases in a confined area can displace oxygen, resulting in an oxygen-deficient atmosphere that poses serious health risks to occupants.

The combination of flammable HC refrigerant gas, an enclosed space, a component of the refrigerant system, namely the evaporator, being within the enclosed space, and the risk of releasing HC refrigerant gas into the enclosed space creates a potential fire and/or explosion hazard. The event of most concern involves a rapid release of the HC refrigerant gas into the enclosed space. This is most likely to occur during a leak or during the process of recharging the refrigerant system of the refrigerated appliance. It will be understood that this event has to be accompanied by a presence of an ignition source that is located in the right place (flammable mixture) and that is strong enough to ignite this mixture. And, it is well known that in the event of ignition, pressure from the expanding ignited HC refrigerant gas, i.e., overpressure, and the thermal pulse from the ignited HC refrigerant gas are the two main causes of personal injury and property damage. It is known that overpressure in the range of 1 to about 3 psi will cause serious injuries and the risk of fatalities, while overpressure at or above 5 psi can cause widespread fatalities.

Those skilled in the art will recognize that from time to time, and for various reasons, the refrigerant in a refrigerated appliances must be replenished, or recharged so that the refrigerated appliance can maintain its desired low temperature. It is known that low levels of the refrigerant gas can lead to a decrease in cooling efficiency or even complete failure of the refrigerated appliance. It is known that the root problem causing the refrigerant level to be low and require recharging must be diagnosed and repaired. Once that is accomplished, and before recharging, any remaining refrigerant gas and moisture in the system must be removed. Because state-of-the-art refrigerant gases, i.e., CFC's, HFC's, and HFO's cannot be vented to the atmosphere, these refrigerant gases must be captured as the system is evacuated. Once the system is properly evacuated, the technician can recharge the system with the appropriate type and amount of refrigerant. As is understood, the state-of-the-art refrigerant is stored and transported, typically, in twenty (20) gallon tanks such as tank 1 in prior art FIGS. 1 and 2. The technician will use a gauge and hose set, such as gauge and hose set 2, in prior art FIGS. 1 and 2, to evacuate and recharge the system. Further, it will be understood that this is typically done in indoors where the refrigerated appliance is located. However, taking a 20-pound tank of an HC refrigerant gas indoors into a confined space creates a serious safety hazard in the event of ignition and/or explosion.

Those skilled in the art will recognize that the amount of refrigerant gas that is charged into the system is monitored by, and sold by, weight. Accordingly, and with reference to prior art FIG. 1, as the CFC, HFC, or HFO gas is charged into the system, tank 1 is weighed, for example on a scale such as scale 5. As a result, and because this weight must account for the weight of the gas present in hose set 2, and due to the fact that different hose sets have different diameter hoses and different length hoses, it can be difficult, and time consuming, to obtain accurate weight measurements, while dispensing small amounts, for instance, the approximately to 90 grams of refrigerant that are typically dispensed when recharging, for example, a residential refrigerator.

Further, it is known in the art that if power to the scale, such as scale 5 is disrupted during the process of dispensing the refrigerant gas, the process, from evacuation to dispensing, must be started over. Further, if something inadvertently vents a hose during dispensing, or if the tank 1 is jostled or knocked from the scale during dispensing, the process must be started over. And, it is understood that starting the process over requires evacuating the system again, typically to 500 microns of vacuum and then recharging the system. The process of evacuating the system can take as long as thirty minutes to an hour or longer depending upon the capacity of the system. This wastes both the refrigerant gas that had been charged into the system and time. Given that the technician is typically being paid by the job and not by the hour, this loss of time, and loss of non-chargeable refrigerant, results in a loss of efficiency and a decrease in productivity for the service company and technician.

What is missing in the art is a method of safely, accurately, and efficiently recharging a refrigerated appliance with a small amount of an HC refrigerant gas in a manner that does not require having a large quantity of HC refrigerant gas in the enclosed space where the refrigerated appliance is located so as to mitigate the hazards of utilizing an HC refrigerant gas within the enclosed spaced.

BRIEF SUMMARY OF THE INVENTION

The present invention is directed towards a method for recharging a refrigerated appliance by weighing small amounts of HC gas, or blended HC gas, refrigerants. These HC refrigerants are then dispensed, into the chilling system of a refrigerated appliance in a confined space. The present method is directed towards accurately, safely, and efficiently weighing out and dispensing small amounts of HC refrigerant gas. In an exemplary embodiment, at least one small container, adapted to contain approximately 50 to 100 grams of the selected HC refrigerant gas, is selected. The refrigerated appliance is then inspected to determine the quantity of the selected HC refrigerant gas is required to be charged into the refrigerated appliance. The container of HC refrigerant gas is weighed in order to precisely determine the amount of HC refrigerant in the container.

When the amount of HC refrigerant gas required to charge a refrigerated appliance is less than the amount of HC refrigerant gas contained within the container, the excess is vented from the container. If, however, the required amount of HC refrigerant gas is greater than the capacity of the container, then more than one container of HC refrigerant gas will be required; and, the fractional amount of HC refrigerant gas within one of the containers, will be vented to the amount of the fractional amount needed. Because HC refrigerant gas is not a greenhouse gas, and has little, if any, detrimental effect on the environment, the excess HC refrigerant gas can be vented to the atmosphere; or, if desired, can be reclaimed. Once the technician confirms that the container now has only 50 grams, i.e. the selected amount, of HC refrigerant gas, each of the five containers holding 90 grams each of the HC refrigerant gas, and the sixth container containing 50 grams of HC refrigerant gas, are each, in turn, connected to the appropriate port on the refrigerated appliance and the HC refrigerant gas is dispensed into the chilling system of the refrigerated appliance until a total of 500 grams of HC refrigerant gas has been dispensed.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

The present invention is directed towards a method for recharging a refrigerated appliance by weighing small amounts of HC gas, or blended HC gas, refrigerants. These HC refrigerants are then dispensed, into the chilling system of a refrigerated appliance in a confined space. It will be understood that hereinafter reference to "HC refrigerant gas" refers to both a single-gas HC refrigerant gas and a blended HC refrigerant gas. In this regard, as discussed above, in the field of refrigerated appliances such as refrigerators, freezers, room air conditioners, small ice makers, wine coolers, and other similar appliances, there is a movement away from using CFC's, HFC's, and HFO's for refrigerant gases, relying instead upon HC, or blended HC, refrigerant gases. As discussed above, refrigerated appliances typically require up to approximately five hundred grams of refrigerant or less. For instance, those skilled in the art will recognize that a commercial refrigerator typically takes about five hundred grams or less of a refrigerant gas while a residential refrigerator typically has a capacity of about ninety (90) grams or less of a refrigerant gas. Thus, the present method is directed towards accurately, safely, and efficiently weighing out and dispensing small amounts of HC refrigerant gas.

Figure 1:
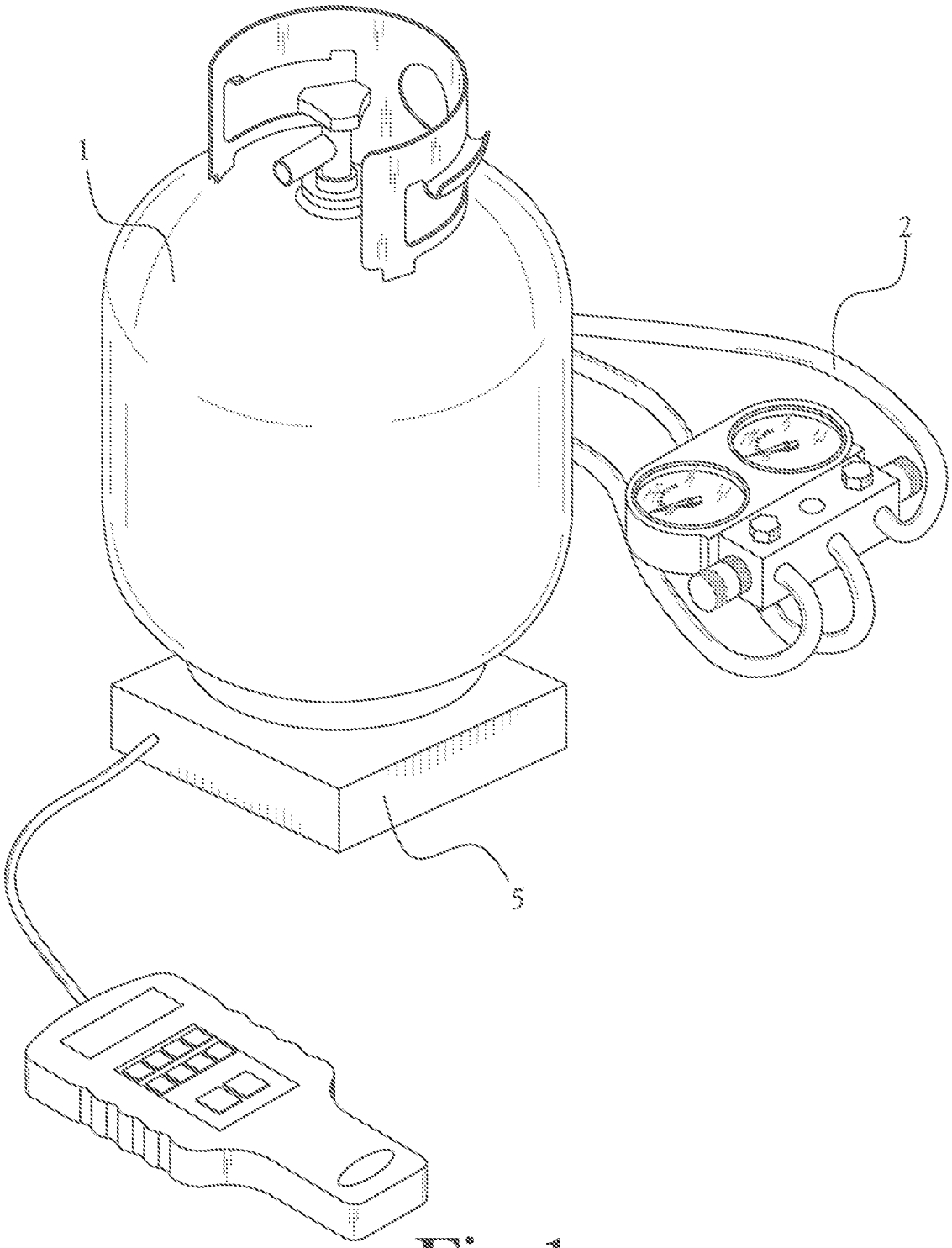
Fig. 1 (PRIOR ART)
FIG. 1 is a perspective view of the prior art method of weighing and dispensing refrigerant gases, such as CFC's, HFC's, and HFO's from a twenty-pound tank using a hose set having various hoses and gauges.
Figure 2B:
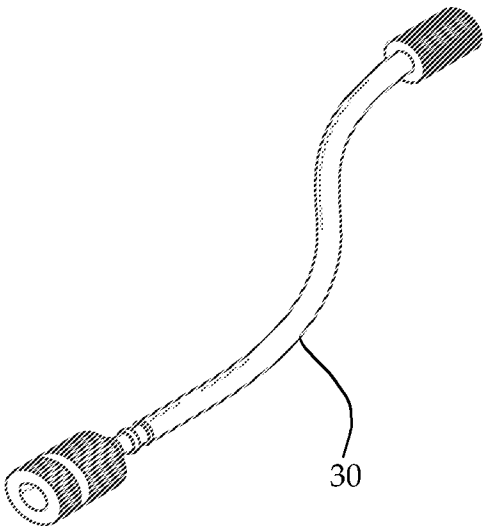
FIG. 2 is a perspective view of the components utilized in the method of the present invention.
Figure 2A:
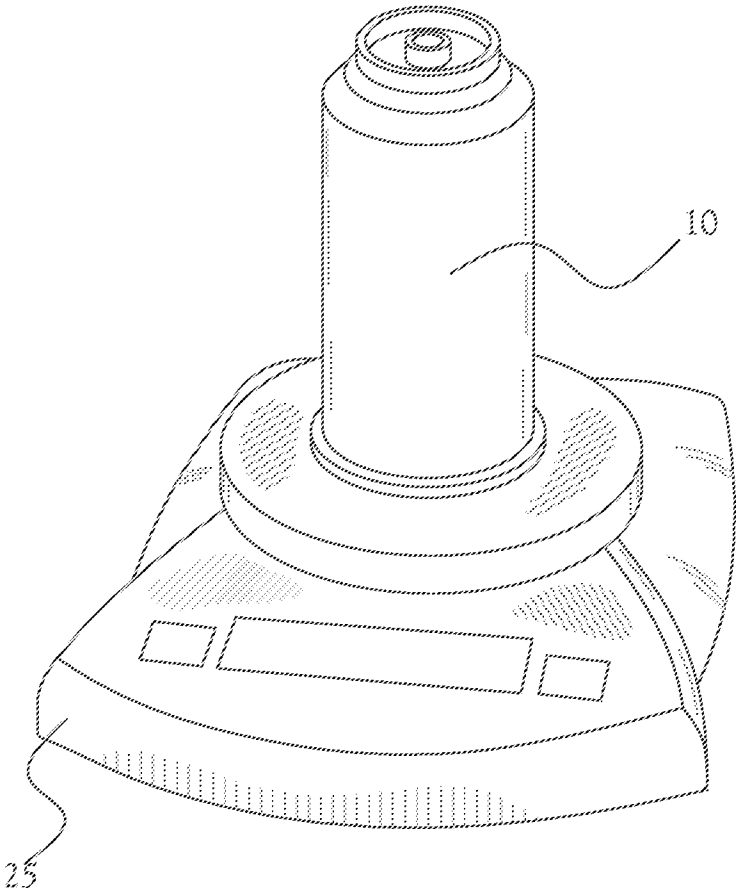
Figure 3:
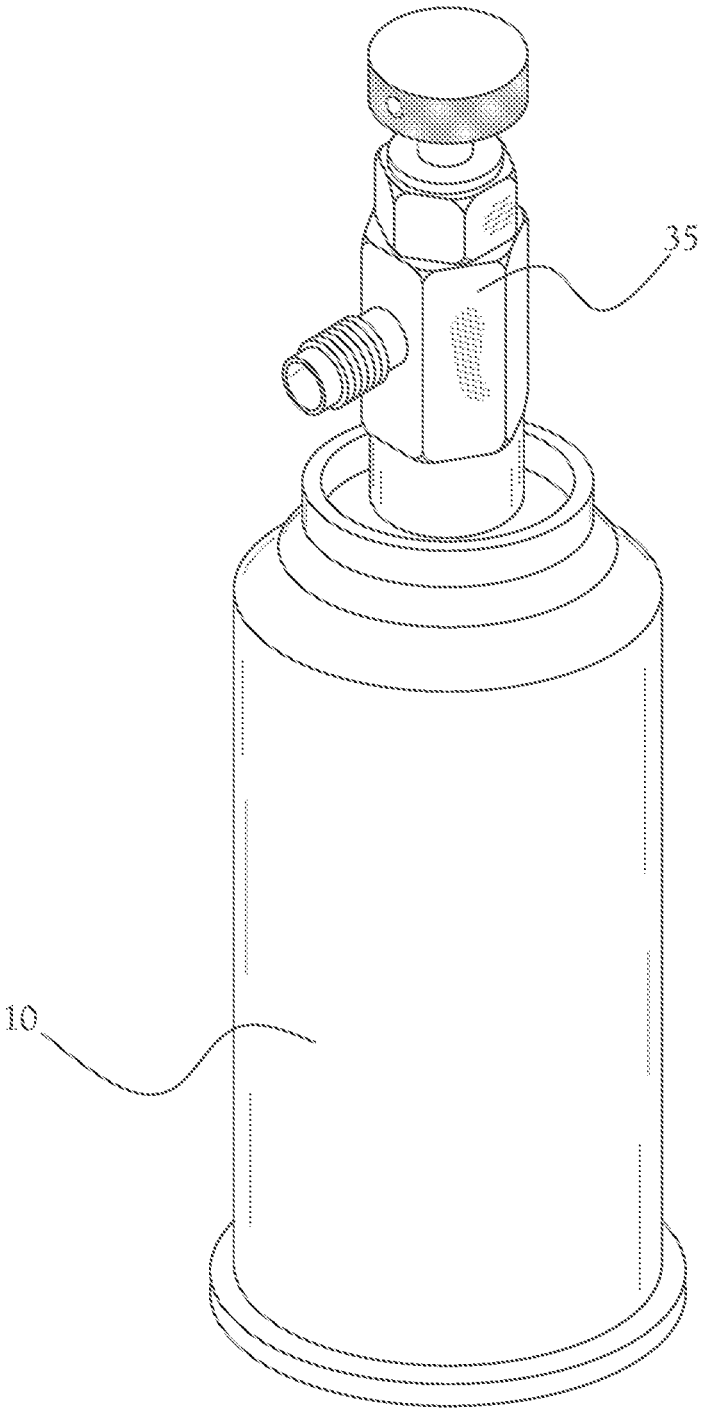
FIG. 3 is a perspective view showing further components utilized in the method of the present invention.
Figure 4:
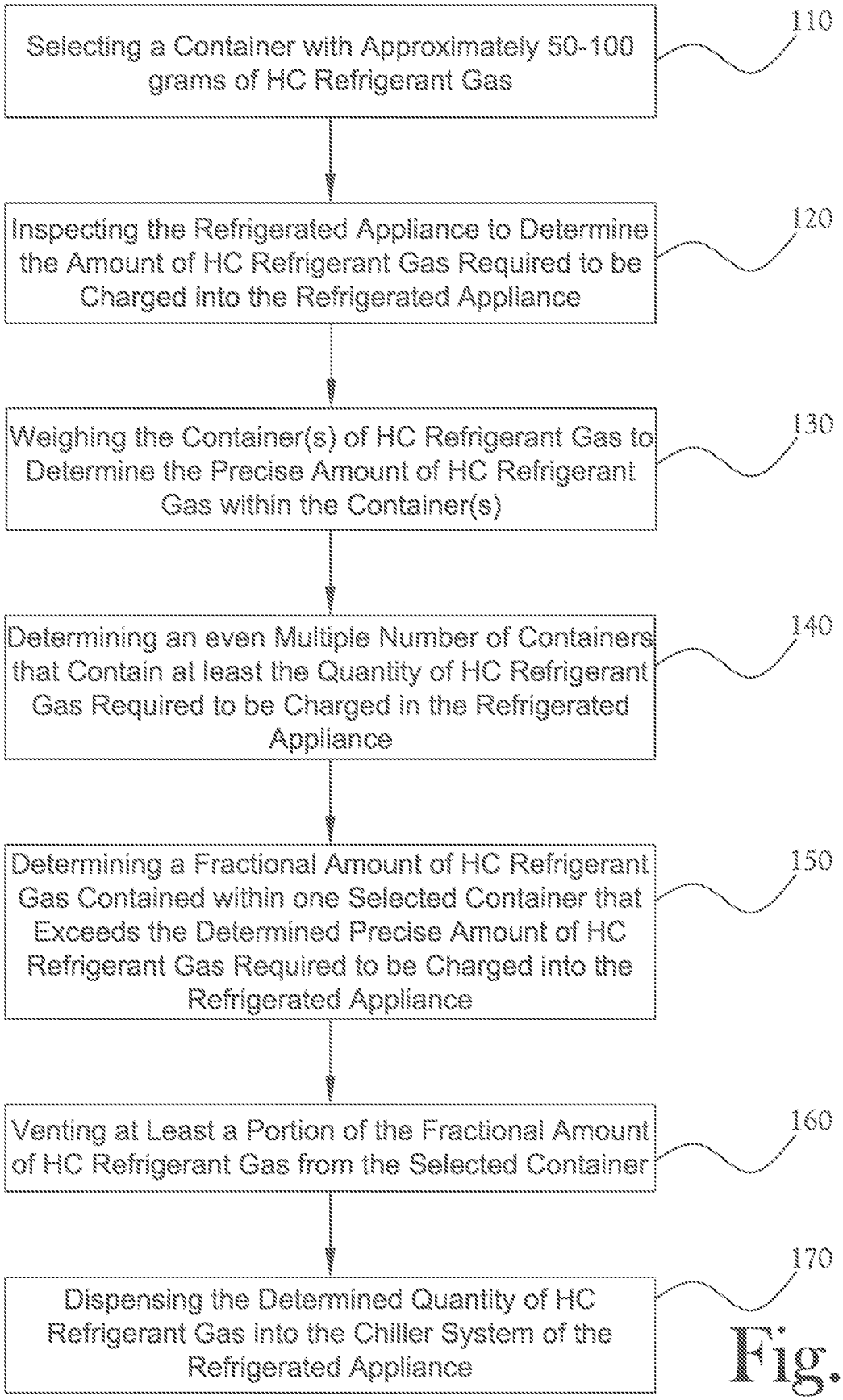
FIG. 4 is a flow chart illustrating the steps of the method of the present invention.

According to the present invention, start with a predetermined amount of HC refrigerant gas in a small container, such as container 10 illustrated in FIG. 2, see step 110 in FIG. 4. In an exemplary embodiment, container 10 contains approximately 50 to 100 grams of the selected HC refrigerant gas. In a further exemplary embodiment, container 10 contains 90 grams of the selected HC refrigerant gas. The refrigerated appliance is then inspected to determine the quantity of the selected HC refrigerant gas required to be charged into the refrigerated appliance, step 120. Container 10 is weighed on a scale, step 130, such as scale 25, in order to precisely determine the amount of HC refrigerant in container 10. In an exemplary embodiment, scale 25 is capable of accurate sub-gram measurements, When the amount of HC refrigerant gas required to charge a refrigerated appliance is less than the amount of HC refrigerant gas contained within container 10, then the excess is vented, step 160, from container 10 with can tap valve 35. If, however, the required amount of HC refrigerant gas is greater than the capacity of container 10, then more than one container 10 will be required; and, the fractional amount of HC refrigerated gas within a container 10 that is required, above an even multiple numbers of containers 10, will be calculated, step 140, and a container 10 will be vented to the amount of the fractional amount needed, step 160. Excess HC refrigerant is vented slowly from container 10 while container is being weighed on scale 25 in order to precisely monitor the amount of HC refrigerant remaining in container 10. In an exemplary embodiment, the step of venting container 10 to the desired weight is performed or accomplished at a selected location away from the enclosed space in which the refrigerated appliance is located. Then, container 10, which now contains the desired amount of HC refrigerant gas, is connected to a selected valve, as appropriate, on the chilling system of the refrigerated appliance by means of a hose 30 and the measured amount of HC refrigerant gas is dispensed into the chiller system of the refrigerated appliance, step 170.

Example 1: Refrigerated Appliance Requires 65 Grams of HC Refrigerant Gas

In this Example, a residential refrigerator requires 65 grams of HC refrigerant gas. And, a service technician has a supply of containers, such as container 10, that each hold 90 gams of HC refrigerant gas. According to the present invention, the technician would connect can tap valve 35 to container 10, place container 10 on scale 25 and confirm that container 10 contains 90 grams of HC refrigerant gas. The technician would then slowly vent 25 grams of HC refrigerant gas from container 10. Because HC refrigerated gas is not a greenhouse gas, and has little, if any, detrimental effect on the environment, the excess HC refrigerated gas can be vented to the atmosphere; or, if desired, can be reclaimed. Once the technician confirms that container now has only 65 grams, i.e. the selected amount, of HC refrigerated gas, container 10 is connected to the appropriate port on the refrigerated appliance with hose 30 and the HC refrigerated gas is dispensed into the chilling system of the refrigerated appliance.

Example 2: Refrigerated Appliance Requires 80 Grams of HC Refrigerant Gas

In this Example, a residential countertop ice maker requires 80 grams of HC refrigerant gas. And, a service technician has a supply of containers, such as container 10, that each hold 90 grams of HC refrigerant gas. According to the present invention, the technician would connect can tap valve 35 to container 10, place container 10 on scale 25 and confirm that container 10 contains 90 grams of HC refrigerant gas. Upon confirming the amount of HC refrigerant gas contained within container 10, the technician would then slowly vent 10 grams of HC refrigerant gas from container 10. Because HC refrigerated gas is not a greenhouse gas, and has little, if any, detrimental effect on the environment, the excess HC refrigerated gas can be vented to the atmosphere; or, if desired, can be reclaimed. Once the technician confirms that container 10 now has only 80 grams, i.e. the selected amount, of HC refrigerated gas, container is connected to the appropriate port on the refrigerated appliance with hose 30 and the HC refrigerated gas is dispensed into the chilling system of the refrigerated appliance.

Example 3: Refrigerated Appliance Requires 500 Grams of HC Refrigerant Gas

In this Example, a commercial refrigerator/freezer requires 500 grams of HC refrigerant gas. And, a service technician has a supply of containers, such as container 10, that each hold 90 grams of HC refrigerant gas. According to the present invention, more than one container 10 will be required. In this example, six 90-gram containers will be required; five of which will be required to discharge or dispense the full 90 grams, leaving a fractional portion of grams that will be required from the sixth container 10. The technician would place each of the first five 90-gram containers 10 on scale 25 and confirm that each of the five 90-gram containers does indeed contain 90 grams of HC refrigerant gas. With the sixth 90-gram container, and similar to the first example, the technician would connect can tap valve 35 to the sixth container, such as container 10, place container 10 on scale 25, confirm that container 10 contains 90 grams of HC refrigerant gas, and then slowly vent 40 grams of HC refrigerant gas from container 10. Because HC refrigerated gas is not a greenhouse gas, and has little, if any, detrimental effect on the environment, the excess HC refrigerated gas can be vented to the atmosphere; or, if desired, can be reclaimed. Once the technician confirms that container 10 now has only 50 grams, i.e. the selected amount, of HC refrigerated gas, each of the five containers holding 90 grams each of the HC refrigerant gas, and the sixth container 10, containing 50 grams of HC refrigerated gas, are each connected to the appropriate port on the refrigerated appliance with hose 30 and the HC refrigerated gas is dispensed into the chilling system of the refrigerated appliance until a total of 500 grams of HC refrigerant gas has been dispensed.

Because in an exemplary embodiment, excess HC refrigerant gas is being vented to the atmosphere, this method could not be used with a CFC, HFC, or HFO refrigerant gas. And, because only small containers, holding pre-measured amounts of HC refrigerant gas, are being taken into the enclosed space where the refrigerated appliance is located, the risks and dangers of a catastrophic explosion are significantly mitigated if not eliminated.

While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

The invention claimed is:

1. A method for weighing and dispensing small amounts of an HC refrigerant gas into a chilling system of a refrigerated appliance, wherein said method comprises:

selecting a container having a predetermined amount of said HC refrigerant gas;

inspecting said refrigerated appliance to determine a quantity of said HC refrigerant gas required to be charged into the refrigerated appliance;

weighing at least one said selected container to determine a precise amount of said HC refrigerant gas contained within said selected container;

determining an even multiple number of said selected containers that contain at least said quantity of said HC refrigerant gas required to be charged in the refrigerated appliance;

determining a fractional amount of said HC refrigerant gas contained within one said selected container that exceeds said determined precise amount of said HC refrigerant gas required to be charged into the refrigerated appliance;

venting at least a portion of said fractional amount of said HC refrigerant gas from at least one said selected container; and dispensing said determined quantity of said HC refrigerant gas required into the chilling system of said refrigerated appliance.

2. The method for weighing and dispensing small amounts of HC refrigerant gas into the chilling system of the refrigerated appliance of claim 1 wherein said refrigerated appliance is selected from a group consisting of refrigerators, room air conditioners, small ice makers, and wine coolers.

3. The method for weighing and dispensing small amounts of HC refrigerant gas into the chilling system of the refrigerated appliance of claim 1 wherein said selected container is adapted to contain between approximately 50 to 100 grams of HC refrigerant gas.

4. The method for weighing and dispensing small amounts of HC refrigerant gas into the chilling system of the refrigerated appliance of claim 3 wherein said selected container is adapted to contain approximately 90 grams of HC refrigerant gas.

5. The method for weighing and dispensing small amounts of HC refrigerant gas into the chilling system of the refrigerated appliance of claim 1 wherein said step of weighing said selected container to determine a precise amount of HC refrigerant gas contained within said selected container is performed with a scale capable of sub-gram accuracy.

6. The method for weighing and dispensing small amounts of HC refrigerant gas into the chilling system of the refrigerated appliance of claim 1 wherein HC refrigerant gas is propane.

7. The method for weighing and dispensing small amounts of HC refrigerant gas into the chilling system of the refrigerated appliance of claim 1 wherein HC refrigerant gas is a blend of propane and butane.

8. The method for weighing and dispensing small amounts of HC refrigerant gas into the chilling system of the refrigerated appliance of claim 1 wherein said fractional amount of said HC refrigerant gas is vented from one said selected container.

9. The method for weighing and dispensing small amounts of HC refrigerant gas into the chilling system of the refrigerated appliance of claim 1 wherein said step of venting at least a portion of said fractional amount of said HC refrigerant gas from at least one said selected container is performed at a selected location away from an enclosed space in which said refrigerated appliance is located.

10. A method for weighing and dispensing small amounts of an HC refrigerant gas into a chilling system of a refrigerated appliance, wherein said method comprises:

selecting a container having a predetermined amount of said HC refrigerant gas wherein said selected container is adapted to contain between approximately 50 to 100 grams of HC refrigerant gas;

inspecting said refrigerated appliance to determine a quantity of said HC refrigerant gas required to be charged into the refrigerated appliance;

weighing at least one said selected container on a scale capable of sub-gram accuracy to determine a precise amount of said HC refrigerant gas contained within said selected container;

determining an even multiple number of said selected containers that contain at least said quantity of said HC refrigerant gas required to be charged in the refrigerated appliance;

determining a fractional amount of said HC refrigerant gas contained within one said selected container that exceeds said determined precise amount of said HC refrigerant gas required to be charged into the refrigerated appliance;

venting at least a portion of said fractional amount of said HC refrigerant gas from at least one said selected container; and dispensing said determined quantity of said HC refrigerant gas required into the chilling system of said refrigerated appliance.

11. The method for weighing and dispensing small amounts of HC refrigerant gas into the chilling system of the refrigerated appliance of claim 10 wherein said refrigerated appliance is selected from a group consisting of refrigerators, room air conditioners, small ice makers, and wine coolers.

12. The method for weighing and dispensing small amounts of HC refrigerant gas into the chilling system of the refrigerated appliance of claim 10 wherein said selected container is adapted to contain approximately 90 grams of HC refrigerant gas.

13. The method for weighing and dispensing small amounts of HC refrigerant gas into the chilling system of the refrigerated appliance of claim 10 wherein HC refrigerant gas is propane.

14. The method for weighing and dispensing small amounts of HC refrigerant gas into the chilling system of the refrigerated appliance of claim 10 wherein HC refrigerant gas is a blend of propane and butane.

15. The method for weighing and dispensing small amounts of HC refrigerant gas into the chilling system of the refrigerated appliance of claim 10 wherein said fractional amount of said HC refrigerant gas is vented from one said selected container.

16. The method for weighing and dispensing small amounts of HC refrigerant gas into the chilling system of the refrigerated appliance of claim 10 wherein said step of venting at least a portion of said fractional amount of said HC refrigerant gas from at least one said selected container is performed at a selected location away from an enclosed space in which said refrigerated appliance is located.

17. A method for weighing and dispensing small amounts of an HC refrigerant gas into a chilling system of a refrigerated appliance, wherein said method comprises:

selecting a container having a predetermined amount of said HC refrigerant gas wherein said selected container is adapted to contain between approximately 50 to 100 grams of HC refrigerant gas;

inspecting said refrigerated appliance to determine a quantity of said HC refrigerant gas required to be charged into the refrigerated appliance;

weighing at least one said selected container on a scale capable of sub-gram accuracy to determine a precise amount of said HC refrigerant gas contained within said selected container;

determining an even multiple number of said selected containers that contain at least said quantity of said HC refrigerant gas required to be charged in the refrigerated appliance;

determining a fractional amount of said HC refrigerant gas contained within one said selected container that exceeds said determined precise amount of said HC refrigerant gas required to be charged into the refrigerated appliance;

venting at least a portion of said fractional amount of said HC refrigerant gas from one said selected container, wherein said fractional amount of said HC refrigerant gas is vented from one said selected container at a selected location away from an enclosed space in which said refrigerated appliance is located; and dispensing said determined quantity of said HC refrigerant gas required into the chilling system of said refrigerated appliance.

18. The method for weighing and dispensing small amounts of HC refrigerant gas into the chilling system of the refrigerated appliance of claim 17 wherein said refrigerated appliance is selected from a group consisting of refrigerators, room air conditioners, small ice makers, and wine coolers.

19. The method for weighing and dispensing small amounts of HC refrigerant gas into the chilling system of the refrigerated appliance of claim 17 wherein said selected container is adapted to contain approximately 90 grams of HC refrigerant gas.

20. The method for weighing and dispensing small amounts of HC refrigerant gas into the chilling system of the refrigerated appliance of claim 17 wherein HC refrigerant gas is selected from a group consisting of propane, butane, and a blend of propane and butane.

* * * * *